US012742260B2

(12) United States Patent
Chae

(10) Patent No.: US 12,742,260 B2
(45) Date of Patent: Sep. 22, 2026

(54) PARA-ARAMID STAPLE FIBER, ARAMID SPUN YARN AND MANUFACTURING METHOD THREOF

(71) Applicant: KOLON INDUSTRIES, INC., Seoul (KR)

(72) Inventor: Yuri Chae, Seoul (KR)

(73) Assignee: KOLON INDUSTRIES, INC., Seoul (KR)

( * ) Notice: Subject to any disclaimer, the term of this patent is extended or adjusted under 35 U.S.C. 154(b) by 90 days.

(21) Appl. No.: 18/556,664

(22) PCT Filed: Aug. 26, 2022

(86) PCT No.: PCT/KR2022/012812
§ 371 (c)(1),
(2) Date: Oct. 20, 2023

(87) PCT Pub. No.: WO2023/038346
PCT Pub. Date: Mar. 16, 2023

(65) Prior Publication Data

US 2024/0368808 A1 Nov. 7, 2024

(30) Foreign Application Priority Data

Sep. 8, 2021 (KR) ..... 10-2021-0119851
Aug. 25, 2022 (KR) ..... 10-2022-0106994

(51) Int. Cl.
*D01F 6/60* (2006.01)
*D02G 3/04* (2006.01)
*D04H 1/00* (2006.01)

(52) U.S. Cl.
CPC ..... *D01F 6/605* (2013.01); *D02G 3/04* (2013.01); *D04H 1/00* (2013.01); *D10B 2331/021* (2013.01); *D10B 2401/063* (2013.01); *D10B 2501/041* (2013.01)

(58) Field of Classification Search
CPC .... D02G 3/04; D01F 6/605; D10B 2331/021; D10B 2401/063; D10B 2501/041
USPC ..... 57/75
See application file for complete search history.

(56) References Cited

U.S. PATENT DOCUMENTS 4,297,407 A * 10/1981 Manca ..... D06M 13/292 442/352
5,051,110 A * 9/1991 Borrell ..... D01F 9/225 252/608
6,254,988 B1 * 7/2001 Zhu ..... D02G 3/047 428/362
11,286,585 B2 * 3/2022 Küsters ..... D01G 21/00
2003/0098068 A1 * 5/2003 Chi ..... D03D 15/283 137/420
2003/0226612 A1 * 12/2003 Zhu ..... D03D 15/283 139/407
2003/0228821 A1 * 12/2003 Zhu ..... A41D 31/08 442/220
2007/0105468 A1 * 5/2007 Chiou ..... D02G 3/047 428/371
2007/0137000 A1 * 6/2007 Bachmann ..... D01G 15/26 19/98
2008/0199695 A1 * 8/2008 Patrick ..... D02G 3/367 428/364
2012/0042442 A1 * 2/2012 Takahashi ..... D03D 15/513 442/187
2012/0144794 A1 * 6/2012 Ke ..... D02G 1/02 57/90
2018/0195214 A1 * 7/2018 Wirth ..... D02G 3/443
2019/0055678 A1 * 2/2019 Hightower, III ..... D03D 15/513
2022/0251737 A1 * 8/2022 Engels ..... D01G 31/003

FOREIGN PATENT DOCUMENTS

| | | | |
|---|---|---|---|
| CN | 102383218 | A | 3/2012 |
| JP | S63190087 | A | 8/1988 |
| JP | H11350248 | A | 12/1999 |
| JP | 2006506555 | A | 2/2006 |
| JP | 2008522055 | A | 6/2008 |
| JP | 2008-274496 | A | 11/2008 |
| JP | 2015098656 | A | 5/2015 |
| JP | 2016186143 | A | 10/2016 |
| JP | 2017-082351 | A | 5/2017 |
| JP | 2017522465 | A | 8/2017 |
| JP | 6685071 | B2 * | 4/2020 |
| KR | 100225367 | B1 | 10/1999 |
| KR | 10-2009-0063269 | A | 6/2009 |
| KR | 20090068272 | A | 6/2009 |
| KR | 101476874 | B1 | 12/2014 |
| KR | 20160010917 | A | 1/2016 |
| KR | 10-2016-0032493 | A | 3/2016 |
| KR | 10-2016-0072408 | A | 6/2016 |
| KR | 20210086467 | A | 7/2021 |
| KR | 10-2292281 | B1 | 8/2021 |

OTHER PUBLICATIONS

Textile Science, Kathryn L. Hatch, University of Arizona Tucson, West Publishing Company (Year: 1993).*
English Translation of JP6685071B2 (Year: 2015).*
The Notice of Allowance dated Sep. 5, 2025.
European Search Report, dated Mar. 26, 2025.
International Search Report dated Dec. 2, 2022.
The Office Action dated Jul. 28, 2025.

* cited by examiner

*Primary Examiner* — Alissa J Tompkins
*Assistant Examiner* — Dakota Marin
(74) *Attorney, Agent, or Firm* — Harvest IP Law, LLP

(57) ABSTRACT

The present invention relates to a para-aramid staple fiber having improved cut resistance by applying a high-elongation yarn of 4% or more, and a method for producing an aramid spun yarn using the same.

4 Claims, No Drawings

PARA-ARAMID STAPLE FIBER, ARAMID SPUN YARN AND MANUFACTURING METHOD THREOF

CROSS-REFERENCE TO RELATED APPLICATION(S)

This application is a National Stage of International Application No. PCT/KR2022/012812 filed on Aug. 26, 2022 claiming the benefit of Korean Patent Application No. 10-2021-0119851, filed on Sep. 8, 2021, and Korean Patent Application No. 10-2022-0106994, filed on Aug. 25, 2022, the contents of each of which are incorporated herein by reference in their entirety.

The present invention relates to a para-aramid staple fiber that can improve cut resistance, an aramid spun yarn and a method for producing the same.

TECHNICAL FIELD

Background Art

Aromatic polyamide fiber commonly called aramid fiber include a para-aramid fiber with a structure in which benzene rings are straightly linked through amide group (CONH) and a meta-aramid fiber without such a structure. The para-aramid fiber has excellent properties such as high strength, high elasticity and low shrinkage. A fine thread having a diameter of about 5 mm fabricated using the para-aramid fiber has an extremely high strength enough to lift up an automobile of about 2 tons in weight.

Such aramid fibers are excellent in heat resistance, flame retardancy, chemical resistance, strength, and the like, and have a dense structure with a strong molecular structure and high crystallinity, and therefore, they have been extensively used in fireproof clothing, protective clothing, safety gloves, and the like.

By the way, recently, as the demand for para-aramid gloves with improved cut resistance has increased depending on the application use, it is important to develop a spun yarn for gloves with improved cut resistance.

Thus, generally, para-aramid staple fibers with a filament elongation of around 3.5% are used to produce an aramid spun yarn, which is then used to manufacture protective gloves. The aramid staple fiber is manufactured by using tow made by combining aramid filaments manufactured using multiple guide rollers, crimping the tow and then cutting it to a certain length.

However, the para-aramid staple fiber has low elongation, and thus, there is still a limit to improving cut resistance.

DETAILED DESCRIPTION OF THE INVENTION

Technical Problem

It is an object of the present invention to provide a para-aramid staple fiber that not only maintains high spinnability and excellent strength by applying filaments with high elongation, but also can greatly improve cut resistance by an increase in the cutting load compared to a conventional one.

It is another object of the present invention to provide an aramid spun yarn having excellent cut resistance and mechanical properties using the high-elongation yarn and staple fiber, and a method for producing the same.

Technical Solution

Provided herein is provided a para-aramid staple fiber having an elongation of 4.1% to 6% and a strength of 15 to 24 g/d.

The para-aramid staple fiber may include a filament bundle having an elongation of 3.5% to 5.5% and a strength of 15 to 24 g/d.

The para-aramid staple fiber may have a fineness of 0.5 to 3.0 de and a fiber length of 20 to 130 mm.

Also provided herein is provided a method for producing an aramid spun yarn, comprising applying the para-aramid staple fiber to a ring spinning process to produce an aramid spun yarn having a Ne16 to Ne30 single yarn and a twist multiplier (TM) in the range of 2.0 to 4.0.

The aramid spun yarn may have a twist multiplier of Ne 20 single yarn in the range of 2.0 to 4.0.

The aramid spun yarn may satisfy an elongation of 3.5% or more and a strength of 7 g/d or more.

The ring spinning process may comprise applying the para-aramid staple fiber to carding, drawing, roving, and spinning processes.

The aramid spun yarn produced as described above may satisfy a cut resistance index of 6 to 15, as measured according to the test method specified in the EN388 Blade Cut Resistance version 2016.

Further provided herein is an aramid spun yarn comprising a para-aramid staple fiber having an elongation of 4.1% to 6% and a strength of 15 to 24 g/d.

Further, the aramid spun yarn satisfies an elongation of 3.5% or more, and a strength of 7 g/d or more. Additionally, the aramid spun yarn satisfies a cut resistance index of 6 to 15, as measured according to the test method specified in the EN388 Blade Cut Resistance version 2016.

The aramid spun yarn produced as described above may be used for protective gloves or protective clothing.

Advantageous Effects

According to the present invention, by applying filament (yarn) having an elongation of 4% or more, which is higher than that of a conventional one, it is possible to provide a method for producing a para-aramid staple fiber that can improve cut resistance by 15 to 60% or more compared to a conventional one, and a method for producing an aramid spun yarn that can produce a spun yarn having improved mechanical properties and cut resistance at a level equivalent to or higher than that of a conventional one.

In addition, the para-aramid staple fiber and spun yarn of the present invention is excellent in the spinnability while having relatively high strength compared to a conventional one, and can satisfy the basic mechanical properties required in the industry.

DETAILED DESCRIPTION OF THE EMBODIMENTS

Now, a para-aramid staple fiber and a method for producing an aramid spun yarn according to embodiments of the invention will be described in more detail.

According to one embodiment of the invention, there can be provided a para-aramid staple fiber having an elongation of 4.1% to 6% and a strength of 15 to 24 g/d.

Recently, as the demand for para-aramid gloves with improved cut resistance has increased depending on the application use, the present inventors conducted research on development of a spun yarn for gloves having improved cut resistance compared to conventional para-aramid spun yarns. As a result, the inventors have found through experiments that in case where a para-aramid staple fiber applied with a yarn having a high elongation of at least 4% or more compared to a conventional one is used, when providing a spun yarn to which the same level of twist multiplier is applied, it can greatly improve the cut resistance compared to a conventional one, and completed the present invention.

In addition, the high-elongation yarn and staple fiber of the present invention can exhibit uniform fineness and spinnability equivalent to or higher than that of a conventional one.

Para-Aramid Staple Fiber

A filament or staple fiber made of para-aramid having high elongation will be described below.

The para-aramid spun yarn can be applied to protective gloves. For example, the para-aramid spun yarn used in the 7-gauge protective gloves generally has a yarn count of 20 or more (Ne20), and is provided by knitting gloves with a 2 ply twisted yarn.

By the way, the para-aramid spun yarn has a low elongation of 4% or less, and thus, there are restrictions on greatly improving the cut resistance.

Therefore, in the present invention, by providing a staple fiber to which para-aramid filaments having an elongation of at least 4% or more, or 4.1% to 6%, or 4.5 to 6% are applied, when the twist multiplier of the spun yarn is equal to or lower than that of a conventional one, it can exhibit the excellent effect of improving cut resistance. That is, as the elongation of the para-aramid filaments and staple fiber increases, flexible properties increase, and due to such properties, it is possible to produce an aramid spun yarn that can improve cut resistance while maintaining excellent mechanical properties even when the twist multiplier equal to or lower than that of a conventional one is applied. In other words, even if the elongation of the para-aramid spun yarn is 4% or less, by adjusting the elongation of the para-aramid filament to a specific range of 4% or more, the cut resistance index can be improved compared to a conventional method. Specifically, when the elongation of the para-aramid filament is 4.5 to 6%, the toughness is increased and the cut resistance of the spun yarn can be further improved. The para-aramid staple fiber may have an elongation of 4.1% to 6% or a strength of 15 to 24 g/d.

The para-aramid staple fiber may include monofilaments having an elongation of 4.1% to 5.5% and a strength of 20 to 30 g/d. More specifically, when the para-aramid staple fiber includes monofilaments having an elongation of 4.2% to 5.5% or 4.5 to 5.5% or 4.6 to 6% and a strength of 20 to 30 g/d, a spun yarn having more excellent cut resistance can be provided.

Additionally, the para-aramid staple fiber may include a filament bundle having an elongation of 3.5% to 5.5% and a strength of 15 to 24 g/d. When the elongation of the filament bundle is 4.2 to 5.5%, 4.5 to 5.5%, or 4.6 to 6%, it can provide more excellent cut resistance to the spun yarn.

If the elongation of the para-aramid staple fiber is 4.1% or less, the cut resistance is not improved, and if the elongation exceeds 6%, there is a problem in the filament manufacturing process, and thus, the filament cannot be produced.

More preferably, if the spun yarn is produced with staple fibers applied with the high-elongation yarn and then used to make gloves, the cutting load increases and the cut resistance (based on EN388 Blade Cut Resistance index) can improve by about 15-60%.

On the other hand, the para-aramid staple fiber having the high elongation can be produced by synthesizing a para-aramid polymer using polyparaphenylene terephthalamide (PPTA) particles having an intrinsic viscosity of 5.0 to 10.0 dl/g, and then subjecting the resulting para-aramid polymer to a uniform discharge step of a spinning dope to produce an aramid staple fiber having an elongation of 4.1% to 6% and a strength of 15 to 24 g/d, including a filament bundle having an elongation of 3.5 to 5.5% and a strength of 20 to 30 g/d using the monofilament.

Specifically, the para-aramid staple fiber having an elongation of 4% or more can be produced by adjusting the elongation by the method comprising the following:

1) aromatic diamine is dissolved in an organic solvent to prepare a mixed solution, 2) aromatic diacid halide is firstly added to the mixed solution and reacted to prepare a prepolymer, 3) aromatic diacid halide is secondarily added to the mixed solution and reacted to prepare a para-aramid polymer, 4) only the polymer having a diameter of 50 to 5,000 μm is selected from the prepared para-aramid polymer and dissolved in sulfuric acid to prepare a spinning dope, and 5) the prepared spinning dope is spun into a fibrous shape, coagulated, washed and dried to produce an aramid filament.

Then, 6) the aramid filaments are brought together to produce a bundle-shaped tow, and then the tow is washed with a spinning oil (for example, under conditions of 50 to 90° C. and 1500 to 5500 l/hr), squeezed at the end of washing (e.g., squeezing roll pressure: 1.0 to 5.0 bar), applied with a primary spinning oil (e.g., applying a spinning oil with a concentration of 1 to 8 wt. % at a temperature of 30 to 70° C.), squeezed at the end of the primary spinning oil application (e.g., squeezing roll pressure: 1.0 to 5.0 bar), and annealed with steam, then crimped (e.g., crimping with a roll pressure of 1.5 to 3.5 bar and stuffer box pressure of 0.3 to 1.8 bar) to give a crimping of 5 to 10/inch, applied with a secondary spinning oil (e.g., applying a secondary spinning oil with a concentration of 1 to 8 wt. % at a rate of 150 to 300 g/min), followed by a drying process (e.g., conditions of 75 to 105° C. and 2 to 6 mpm) and a cutting process (e.g., draw ratio of 3 to 15% and conditions of 50 to 100 mpm), and passing through a baler (e.g., conditions of 30 to 60 Hz) to produce a para-aramid staple fiber.

The para-aramid polymer for producing the para-aramid staple fiber can be produced by using aromatic diamine and aromatic diacid or a derivative thereof as monomers, and an inorganic salt as a catalyst in a polar solvent, and subjecting to vigorous stirring at a temperature of −10 to 50° C.

The aromatic diamine may include para-phenylenediamine, 4,4'-diaminobiphenyl, 2,6-naphthalenediamine, 1,5-naphthalenediamine, 4,4'-diaminobenzanilide, and the like.

Examples of the aromatic diacid or a derivative thereof may include aromatic diacid halide, and the aromatic diacid halide may include terephthaloyl dichloride, 4,4'-benzoyl dichloride, 2,6-naphthalenedicarboxylic acid dichloride, 1,5-naphthalenedicarboxylic acid dichloride, and the like.

The organic solvent may include N-methyl-2-pyrrolidone (NMP), N, N'-dimethylacetamide (DMAc), hexamethylphosphoramide (HMPA), N,N,N',N'-tetramethyl urea (TMU), N,N-dimethylformamide (DMF) and mixtures thereof.

The inorganic salt may include $CaCl_2$, LiCl, NaCl, KCl, LiBr, and KBr.

The aromatic diamine may include para-phenylenediamine, 4,4'-diaminobiphenyl, 2,6-naphthalenediamine, 1,5-naphthalenediamine, and 4,4'-diaminobenzanilide.

The aromatic diacid halide may include terephthaloyl dichloride, 4,4'-benzoyl dichloride, 2,6-naphthalenedicarboxylic acid dichloride, 1,5-naphthalenedicarboxylic acid dichloride, and the like.

At this time, the prepolymer may be subjected to aging treatment for 0 to 48 hours, or the content of inorganic salt in the polymerization solvent may be adjusted to 40 to 60 wt. % relative to the content of the monomers.

Next, the prepared para-aramid polymer is dissolved in sulfuric acid to prepare a spinning dope, the spinning dope is then spun into a fibrous shape through a spinneret, the spun fiber is coagulated while passing through a coagulation tank and a coagulation tube, washed and dried while passing through a washing roller and a drying roller in order, and then wound around a winding roller to produce para-aramid fiber.

As used herein, "staple fiber" has a certain length cut from a monofilament.

Therefore, the para-aramid staple fiber produced by the above method may have a fineness of 0.5 to 3.0 de and a fiber length of 20 to 130 mm.

The fineness can be measured using a FAVIMAT device. Further, the fiber length can be measured by a method of measuring with the naked eye using a ruler.

Method for Producing Aramid Spun Yarn, and Aramid Spun Yarn

On the other hand, according to another embodiment of the invention, there can be provided a method for producing an aramid spun yarn, comprising applying the para-aramid staple fiber to a ring spinning process to produce an aramid spun yarn having a Ne16 to Ne30 single yarn and a twist multiplier (TM) in the range of 2.0 to 4.0.

At this time, "Ne" as used herein represents the British cotton count (Ne) used to indicate the count (thickness) of the spun yarn. In addition, the yarn count means the length per unit weight ('s) when a yarn having a length of 840 yds is made from 1 lb weight of cotton.

According to the present invention, filaments or staples made of para-aramid with high elongation can be used to provide a spun aramid yarn with excellent cut resistance, and are therefore described in more detail below.

As mentioned above, the para-aramid staple fiber has a feature that it has an elongation of 4.1% to 6%, which is higher than that of a conventional fiber, and also has a strength of 15 to 24 g/d.

Such a para-aramid staple fiber can be applied even at a relatively high carding speed, and for example, even when carded at a speed of 30 kg/hr or more, it can have high uniformity and excellent mechanical properties, thereby realizing high spinnability and excellent spinning yield.

The present invention can greatly improve the cut resistance compared to a conventional one when providing spun yarn applied with a twist multiplier equal to that of a conventional one. That is, in addition to filaments or staple fibers made of para-aramid with high elongation during production of the spun yarn, setting the twist multiplier to a certain range can contribute to improving the cut resistance of aramid spun yarn. In other words, by setting the twist multiplier within a certain range in addition to filaments or staple fibers made of para-aramid having high elongation during production of the spun yarn, it is possible to contribute to improving the cut resistance of the aramid spun yarn.

Specifically, the aramid spun yarn can be manufactured by applying a para-amarid staple fiber having the above-mentioned characteristics and performing a ring spinning process to have a single yarn with a count of Ne16 to Ne30, adjusting the twist multiplier (TM) of such a single yarn to be in the range of 2.0 to 4.0, and plying the yarns. Therefore, when a twist multiplier applied to the above range within the count of the single yarn, the aramid spun yarn can improve cut resistance compared to a conventional one. In addition, even if the twist multiplier is the same as before within the count of the single yarn, the para-aramid staple fibers having specific physical properties are used, and thus, the cut resistance of the plied aramid spun yarn can be further improved.

More specifically, the aramid spun yarn may have a twist multiplier (TM) of a Ne20 single yarn in the range of 2.0 to 4.0 or 2.0 to 3.5 or 2.0 to 3.0 or 2.0 to 2.5. Further, the aramid spun yarn may satisfy a plied spun yarn elongation of 3.5% or more and a strength of 7 g/d or more. At this time, when the count of the aramid spun yarn is Ne20, if the twist multiplier (TM) of the single yarn with a count of Ne20 is 2.0 or less, there is a problem that the twist multiplier is too small and the single fibers are unwound, which makes it difficult to produce the spun yarn. In addition, if the twist multiplier (TM) of the Ne20 single yarn is 4.0 or more, the spun yarn becomes stiff due to excessive twisting, which may reduce wearing comfort and may distort the shape of the produced glove.

In such a case, gloves made using spun yarn can achieve cut resistance improved by 15 to 60% compared to the conventional gloves.

According to one preferred embodiment, the aramid spun yarn produced as described above may satisfy a cut resistance index of 12 to 18, as measured according to the test method specified in the EN388 Blade Cut Resistance version 2016. More specifically, the cut resistance index may be 12 to 17 or 12.3 to 16.7.

Furthermore, the ring spinning process can be provided according to methods well known in the art. For example, the ring spinning process includes subjecting para-aramid staple fibers to carding, drawing and spinning processes to provide a spun yarn having the above single yarn range and twist multiplier. At this time, a blowing process may be further included before the carding process. Additionally, it may further include a roving process to stretch the sliver and provide minimal twisting after the drawing process is completed.

More specifically, the step of carding the para-aramid staple fiber at a rate of 30 kg/hr or more may be carried out under the conditions where the density of a card clothing of a fixed carding bar in a carding machine is applied at 200 to 700 PPSI for a doffer upper end and 10 to 400 PPSI for a licker-in upper end, and a cylinder speed is applied at 200 to 500 rpm.

The aramid spun yarn produced as described above can satisfy an elongation of 3.5% or more and a strength of 7 g/d or more for Ne16 to Ne30 single yarns and plied spun yarns.

The method for producing an aramid spun yarn may comprise thinning a sliver or roving, which is a continuous fiber bundle, and brining the fiber bundles together to give a twisting.

Additionally, the method for producing an aramid spun yarn may further include bringing the sub-slivers obtained after the carding step together to perform a drawing step and a spinning step.

The aramid filaments are brought together using a plurality of guide rollers to produce a bundle-shaped tow, and then the tow is washed with a spinning oil), squeezed at the end of washing, applied with a primary spinning oil, squeezed at the end of the primary spinning oil application and annealed with steam, then crimped to give a crimping of 5 to 10/inch, applied with a secondary spinning oil, followed by a drying process and a cutting process and passing through a baler to produce a para-aramid staple fiber.

The produced aramid staple fiber can be subjected to a carding process to manufacture a plurality of sub-slivers. That is, the short aramid fibers can be arranged in parallel through the carding process to obtain a sub-sliver which is a fiber aggregate.

Then, after bringing the sub-slivers together, a minimum twisting is given to the sliver through a drawing process to maintain its strength, and then the sliver is twisted simultaneously with drawing through the spinning process to produce an aramid spun yarn.

Therefore, according to another embodiment of the invention, there can be provided an aramid spun yarn comprising para-aramid staple fibers having an elongation of 4.1% to 6% and a strength of 15 to 24 g/d.

Therefore, as described above, the aramid spun yarn according to the present invention may have a single yarn with a count of Ne16 to Ne30, and a twist multiplier (TM) of 2.0 to 4.0.

Further, the aramid spun yarn satisfies an elongation of 3.5% or more and a strength of 7 g/d or more. Additionally, the aramid spun yarn satisfies a cut resistance index of 6 to 15, as measured according to the test method specified in the EN388 Blade Cut Resistance version 2016.

At this time, the strength and elongation of para-aramid monofilament, para-aramid staple fiber, and para-aramid spun yarn according to the present invention can be evaluated based on the KS K ISO 2062 test method. Further, the setting conditions for gauge length and test speed can be measured according to the contents in the manual.

Further, the cut resistance index of the spun yarn can be evaluated based on the test method specified in the EN388 Blade Cut Resistance version 2016. Therefore, the aramid spun yarn has excellent cut resistance, and thus can be applied to products including protective gloves or protective clothing, and more preferably, can be used for protective gloves. The protective gloves include 7-gauge protective gloves, and the protective clothing may include firefighting clothing, welding clothing, occupational protective clothing, and the like. The product may be a knitted fabric or woven fabric containing aramid spun yarn. Most preferably, the product may be a 7-gauge protective glove containing a knitted aramid yarn. The knitted fabric or woven fabric may be woven as is well known in the art.

As described above, the present invention can provide the effect of improving cut resistance even when high-elongation yarn/staple is applied and TM is low, so that it can reduce the risk of injury to workers and thus improve stability when applied to protective gloves (e.g., 7 gauge gloves) and protective clothing.

The invention will be explained in more detail with reference to the following examples. However, the following examples are for illustrative purposes only, and the scope of the present invention is not limited thereby.

EXAMPLE AND COMPARATIVE EXAMPLE: PRODUCTION OF ARAMID STAPLE FIBER AND ARAMID SPUN YARN

As shown in Tables 1 and 2, para-aramid staple fibers and aramid spun yarns were produced by changing the yarn properties and spinning conditions.

Example 1

A mixed solvent containing NMP as an organic solvent and $CaCl_2$) as an inorganic salt in a weight ratio of 92:8 was placed in a reactor under a nitrogen atmosphere, and p-phenylene diamine (PPD) was added thereto so that the concentration of PPD in the slurry was 5 wt. %, to prepare a slurry.

Then, terephthaloyl chloride (TPC) corresponding to 40 mol % of the number of moles of PPD was added to the slurry and then reacted to prepare a para-aramid prepolymer.

Subsequently, TPC corresponding to 60 mol % of the number of moles of PPD was secondarily added to the prepared para-aramid prepolymer and then reacted to prepare a para-aramid polymer.

The para-aramid polymer obtained as described above was dissolved in 99.8 wt. % sulfuric acid at 19 wt. % based on the total weight of the spinning dope to produce a spinning dope. The dope was then spun into a fibrous shape through a spinneret, the spun fiber was coagulated while passing through a coagulation tank and a coagulation tube, washed and dried while passing through a washing roller and a drying roller in order, and then wound around a winding roller to produce a para-aramid filament having a single yarn fineness of 1.5 denier and an elongation of 4.9%. At this time, the elongation of the para-aramid filament bundle (bundle) was 4.5%.

Next, the aramid filaments were brought together using a plurality of guide rollers to produce a bundle-shaped tow, and then the tow was washed with a spinning oil, squeezed at the end of washing, applied with a primary spinning oil, squeezed at the end of the primary spinning oil application, annealed with steam, then crimped to give a crimping of 5 to 10/inch and applied with a secondary spinning oil, followed by a drying process and a cutting process and passing through a baler to produce a para-aramid staple fiber.

Next, the para-aramid staple fiber was subjected to a ring spinning process to produce an aramid spun yarn.

Specifically, under the conditions where the density of a card clothing of a fixed carding bar in a carding machine was applied at 200 to 700 PPSI for a doffer upper end and 10 to 400 PPSI for a licker-in upper end, and a cylinder speed was applied at 200 to 500 rpm, a high-speed carding process of 30 kg/hr or more was carried out to produce para-aramid staple fibers into multiple sub-slivers. Each sub-sliver was then brought together, and then subjected to a drawing process to give a twisting to the sliver at the level shown in Table 1 and maintain the strength. Then, through the roving and spinning processes, the sliver was twisted simultaneously with drawing to produce a single yarn with a count of 20 (Ne 20) and a twist multiplier (TM) of 2.3 TM, and 2 single yarn strands were brought together to produce an aramid 2-ply spun yarn. (final product count of spun yarn: 20/2)

Example 2

Para-aramid staple fiber and aramid spun yarn were produced in the same manner as in Example 1, except that the twist multiplier of a single yarn with a count of 20 (Ne20) during production of the spun yarn was set to TM2.9 as shown in Table 1 below.

Example 3

Para-aramid staple fiber and aramid spun yarn were produced in the same manner as in Example 1, except that the twist multiplier of a single yarn with a count of 20 (Ne20) during production of spun yarn was set to TM3.5 as shown in Table 1 below.

Example 4

Para-aramid staple fiber and aramid spun yarn were produced in the same manner as in Example 1, except that para-aramid monofilament and para-aramid staple fibers having an elongation of 4.1% were used as shown in Table 1 below.

Comparative Example 1

Aramid spun yarn was produced in the same manner as in Example 1, except that the para-aramid staple fiber commonly used in the past according to the conditions of Table 1 having an elongation of 4.0% and a strength of 20 g/d were used as shown in Table 2 below.

Comparative Example 2

Aramid spun yarn was produced in the same manner as in Example 2, except that the para-aramid staple fiber commonly used in the past according to the conditions of Table 1 having an elongation of 4.0% and a strength of 20 g/d were used as shown in Table 2 below.

Comparative Example 3

Aramid spun yarn was produced in the same manner as in Example 3, except that the para-aramid staple fiber commonly used in the past according to the conditions of Table 1 having an elongation of 4.0% and a strength of 20 g/d were used as shown in Table 2 below.

Experimental Example

The properties of the para-aramid fibers and spun yarns of Examples and Comparative Examples were evaluated by the following method, and the results were as shown in Table 1 and Table 2 below.

(1) Measurement of Strength and Elongation of Monofilament, Staple Fiber and Spun Yarn The spun yarn was evaluated using a USTER equipment using the KS K ISO 2062 test method, and the setting conditions for gauge length and test speed were measured according to the contents of the manual.

(2) Measurement of Cut Resistance

The cut resistance of Examples and Comparative Examples was evaluated based on the test method specified in the EN388 Blade Cut Resistance version 2016. The cut resistance was evaluated by manufacturing knitted fabrics using the para-aramid spun yarns of Examples and Comparative Examples through glove knitting using a glove knitting machine of the size used for 7 gauge protective gloves (manufactured with 100% para-aramid spun of 20 count, 2 ply, 5 strands).

TABLE 1

| | | Example 1 | Example 2 | Example 3 | Example 4 |
|---|---|---|---|---|---|
| Filament bundle | Elongation(%) | 4.5 | 4.5 | 4.5 | 3.7 |
| | Strength(g/d) | 22.7 | 22.7 | 22.7 | 21.7 |
| Monofilament | Elongation(%) | 4.9 | 4.9 | 4.9 | 4.1 |
| | Strength(g/d) | 24.3 | 24.3 | 24.3 | 24.6 |
| Staple yarn | Elongation(%) | 4.9 | 4.9 | 4.9 | 4.1 |
| | Strength(g/d) | 18.9 | 18.9 | 18.9 | 19.2 |
| Spun yarn | Elongation(%) | 3.5 | 3.5 | 3.8 | 3.5 |
| | Strength(g/d) | 8.5 | 7.6 | 8.1 | 8.0 |
| Spun single yarn TM | | 2.3 | 2.9 | 3.5 | 2.9 |
| Cut resistance index | | 16.7 | 14.4 | 12.3 | 11.9 |

TABLE 2

| | | Comparative Example 1 | Comparative Example 2 | Comparative Example 3 |
|---|---|---|---|---|
| Filament bundle | Elongation(%) | 3.5 | 3.5 | 3.5 |
| | Strength(g/d) | 21.5 | 21.5 | 21.5 |
| Monofilament | Elongation(%) | 4.0 | 4.0 | 4.0 |
| | Strength(g/d) | 25.4 | 25.4 | 25.4 |
| Staple yarn | Elongation(%) | 4.0 | 4.0 | 4.0 |
| | Strength(g/d) | 19.9 | 19.9 | 19.9 |
| Spun yarn | Elongation(%) | 3.2 | 3.5 | 3.9 |
| | Strength(g/d) | 9.3 | 8.6 | 8.6 |
| Spun single yarn TM | | 2.3 | 2.9 | 3.5 |
| Cut resistance index | | 11.4 | 10.4 | 10.2 |

As shown in Table 1 and Table 2, the aramid spun yarns of Examples 1 to 4 used para-aramid staple fibers with an elongation in the range of 4.1% to 6% and a strength of 15 to 24 g/d, and therefore, when the twist multiplier of the spun yarn was imparted to the same level as before (the twist multiplier of single yarn with a count 20 (Ne 20) was TM 2.3 to 3.5), they exhibited greatly improved cut resistance compared to Comparative Examples 1 to 3. Particularly, the present invention applies high elongation yarn and staple fiber, and therefore, when the TM was lowered to about 2.3, the cut resistance was greatly improved compared to Comparative Examples 1 to 3. That is, it was confirmed that in Examples 1 to 3, the cut resistance of the spun yarn is further improved by using para-aramid staple fibers containing filament bundles with a strength of 22.7 g/d and a high elongation of 4.5%. Particularly, Example 1 can exhibit the highest cut resistance even at a low twist multiplier, thereby providing a protective glove with excellent quality and stability. In addition, Example 4 using yarns with an elongation of 4.1% exhibited further improved cut resistance compared to Comparative Example 1 using yarns with an elongation of 4.0%.

On the other hand, Comparative Examples 1 to 3 used staple fibers with an elongation of 4.0%, which is the level generally applied, and the elongation of the filament bundle included in the para-aramid staple fibers was 3.5% and showed a strength of 21.5 g/d, and therefore, it can be seen that when applying the twist multiplier (the twist multiplier of a single yarn with a count of 20 (Ne 20); TM 2.3 to 3.5) under the same conditions as Examples 1 to 3, they exhibited relatively lower cut resistance than Examples.

The invention claimed is:

1. A method for producing an aramid spun yarn, comprising applying a para-aramid staple fiber to a ring spinning process to produce an aramid spun yarn having a Ne16 to Ne30 single yarn and a twist multiplier (TM) in the range of 2.0 to 4.0, wherein the ring spinning process includes a carding process at a speed of 30 kg/hr or more, wherein the ring spinning process comprises applying the para-aramid staple fiber to carding, drawing, roving, and spinning processes, wherein the carding process is carried out under the conditions where the density of a card clothing of a fixed carding bar in a carding machine is applied at 200 to 700 PPSI for a doffer upper end and 10 to 400 PPSI for a licker-in upper end, and a cylinder speed is applied at 200 to 500 rpm, and wherein the para-aramid staple fiber has an elongation of 4.1% to 6% and a strength of 15 to 24 g/d.

2. The method for producing the aramid spun yarn according to claim 1, wherein:

the aramid spun yarn has a twist multiplier of Ne 20 single yarn in the range of 2.0 to 4.0.

3. The method for producing the aramid spun yarn according to claim 1, wherein:

the aramid spun yarn satisfies an elongation of 3.5% or more and a strength of 7 g/d or more.

4. The method for producing the aramid spun yarn according to claim 1, wherein:

the produced aramid spun yarn satisfies a cut resistance index of 12 to 18, as measured according to the test method specified in the EN388 Blade Cut Resistance version 2016.

* * * * *